US006442908B1

(12) United States Patent
Naccarato et al.

(10) Patent No.: US 6,442,908 B1
(45) Date of Patent: Sep. 3, 2002

(54) OPEN WEB DISSYMMETRIC BEAM CONSTRUCTION

(76) Inventors: Peter A. Naccarato, 7000 Tulip St., Philadelphia, PA (US) 19135; John A. Costanza, 407 Kings Highway, Cherry Hill, NJ (US) 08033; Daniel G. Fisher, 215 Munn La., Cherry Hill, NJ (US) 08034

( * ) Notice: Subject to any disclaimer, the term of this patent is extended or adjusted under 35 U.S.C. 154(b) by 0 days.

(21) Appl. No.: 09/559,885

(22) Filed: Apr. 26, 2000

(51) Int. Cl.[7] ..... E04B 1/20
(52) U.S. Cl. ..... 52/236.8; 52/250; 52/435
(58) Field of Search ..... 52/250, 435, 236.8

(56) References Cited

U.S. PATENT DOCUMENTS

| | | | | | |
|---|---|---|---|---|---|
| 1,957,026 | A | * | 5/1934 | Lasker | 52/283 |
| 1,990,001 | A | * | 2/1935 | Rutten | 52/250 |
| 2,006,070 | A | * | 6/1935 | Stasio | 52/259 |
| 2,021,434 | A | * | 11/1935 | Shaw | 52/435 |
| 2,233,054 | A | * | 2/1941 | Heeren | 52/338 |
| 2,851,875 | A | * | 9/1958 | Astorga | 52/236.6 |
| 3,130,470 | A | * | 4/1964 | Bowden | 52/250 |
| 3,495,371 | A | * | 2/1970 | Mitchell | 52/236.7 |
| 3,594,971 | A | * | 7/1971 | Hughes | 52/236.7 |
| 3,732,650 | A | * | 5/1973 | Gwilliam | 52/236.9 |
| 5,113,631 | A | * | 5/1992 | diGirolamo | 52/236.8 |
| 5,704,181 | A | * | 1/1998 | Fisher | 52/438 |
| 6,012,256 | A | * | 1/2000 | Aschheim | 52/167.1 |
| 6,049,932 | A | * | 4/2000 | Mangone | 52/668 |

FOREIGN PATENT DOCUMENTS

| | | | | |
|---|---|---|---|---|
| GB | 570665 | * | 7/1945 | 52/322 |
| IT | 429978 | * | 12/1948 | 52/322 |
| WO | W088028803 | * | 4/1988 | 52/236.8 |

* cited by examiner

*Primary Examiner*—Beth A. Stephan
(74) *Attorney, Agent, or Firm*—Armand M. Vozzo, Jr.

(57) ABSTRACT

An improved structural framing system and associated method of construction is disclosed wherein an open web dissymmetric steel beam fabricated having a plurality of trapezoidal openings formed along the web thereof between a narrowed, thickened top flange and a widened bottom flange is horizontally disposed and supported between adjacent vertical columns erected on conventional foundations. The dissymmetric beam is preferably fabricated from a standard rolled, wide flange beam split longitudinally according to a specific cutting pattern to produce substantially identical open web beam sections having a single wide flange. A flat bar plate is then welded along the open web beam section to provide the top flange and thereby produce the dissymmetric beam for use in the present system. Standard hollow core sections of precast concrete plank are assembled together perpendicularly to the open web dissymmetric beam and supported upon the bottom flange on either side thereof so that the open web of the beam is centrally disposed between end surfaces of the plank sections in substantially the same horizontal plane. A high-strength grout mixture applied to the assembled beam and plank sections is made to flow completely through the web openings in a circulatory manner thereby creating a substantially monolithic concrete encasement around the dissymmetric beam that improves the resulting composite action and mechanical interlock between the steel beam and concrete plank and prevents loss of strength due to separation of the grout from either side of the beam.

7 Claims, 3 Drawing Sheets

OPEN WEB DISSYMMETRIC BEAM CONSTRUCTION

BACKGROUND OF THE INVENTION

The present invention relates to the construction of multi-story buildings, and more particularly to an improved composite structural framing system and associated method of construction wherein concrete plank sections are assembled and grouted about a specially adapted open web dissymmetric steel beam having a plurality of openings made through the web of the beam along the length thereof to improve grout flow through and about the beam so that the resulting concrete encasement of the beam develops greater composite action and structural integrity in the system.

In the field of building construction, particularly in those buildings of multiple stories, the framing system provides the essential load bearing element that characterizes and determines the load carrying capacity and structural integrity of the building. Designed to comply with standard building code requirements, the framing systems of modern multi-story buildings are generally made of heavy, fire-resistive materials, such as structural steel and concrete. Typically consisting of a plurality of vertical steel columns and horizontal steel beams extending between and connected to each column, the standard framing system further includes floors of reinforced concrete that may be precast or cast-in place supported by and between the horizontal beams on each level. While each framing system must be designed to safely carry all of the anticipated vertical loads affecting the building and provide stabilization against lateral loads caused by wind or other horizontal forces, it is important that the system be easy to assemble and cost-effective as well in order to afford its use in modern construction projects.

In recent years, revisions to the national and international building code standards, particularly those model provisions of the Building Officials and Code Administrators International, Inc. (BOCA), have increased lateral load requirements for seismic design criteria, especially affecting multi-story building construction. As a result, the framing systems of most prospective multi-story building structures will be required to resist lateral loads greater than those able to be accommodated by much of the existing structural framework incorporated into building construction over the last few decades. Because of the increased seismic design criteria and the continuing pressure of minimizing construction costs, new design alternatives for structural framing systems have been developed in order to meet all of the current loading requirements imposed upon modern multi-story buildings in an economical and cost-effective manner.

One recent design alternative for a structural framing system is described in U.S. Pat. No. 5,704,181 wherein a dissymmetric steel beam having a compressed, block-like top flange, a flattened bottom flange, and a continuous solid web integrally extending therebetween is adapted to be horizontally disposed between adjacent vertical steel columns that are erected upon conventional foundations. Standard hollow core sections of precast, prestressed concrete plank are then installed along either side of the dissymmetric beam supported upon the bottom flange and together assembled so that the beam is disposed centrally between facing edges of the plank sections all in substantially the same horizontal plane. Grouting of the assembled beam and plank sections then provides encasement of the beam, interlocking the beam and plank sections and developing a composite action that enhances the loadbearing capacity of the system. While the framing system of the aforementioned patent has performed satisfactorily and produced increased loadbearing results in testing that are indicative of the development of composite action between the steel beam and the concrete plank, further testing has indicated a need to guarantee a more homogeneous and uniform bond between the structural steel and the precast concrete in order to ensure the maintenance of the interlocking effect and the composite action initially developed by the aforedescribed framing system.

SUMMARY OF THE INVENTION

Accordingly, it is a general purpose and object of the present invention to provide an improved structural framing system and associated method of construction that increases the structural integrity and load carrying characteristics of multi-story buildings.

A further object of the present invention is to provide a structural framing system and method of constructing same that provides a more effective and economical means for supporting the loading requirements of modern-day building structures, particularly those having multiple stories, than those structural framing systems heretofore developed.

A more specific object of the present invention is to provide an improved composite assembly of structural elements in a framing system for multi-story construction that is capable of handling all the loading requirements now specified under applicable building codes, including those lateral load requirements associated with potential seismic activity, within a minimum building elevation, and adapted to better maintain its composite strength and structural integrity over the useful life of the construction.

A still further object of the present invention is to provide a safe and effective structural framing system that may be assembled and implemented using relatively standard construction materials and equipment.

Briefly, these and other objects of the present invention are accomplished by an improved structural framing system and associated method of construction wherein an open web dissymmetric steel beam fabricated having a plurality of trapezoidal openings formed along the web thereof between a narrowed, thickened top flange and a widened bottom flange is horizontally disposed and supported between adjacent vertical columns erected on conventional foundations. The dissymmetric beam is preferably fabricated from a standard rolled, wide flange beam split longitudinally according to a specific cutting pattern to produce substantially identical open web beam sections having a single wide flange. A flat bar plate is then welded along the open web beam section to provide the top flange and thereby produce the dissymmetric beam for use in the present system. Standard hollow core sections of precast concrete plank are assembled together perpendicularly to the open web dissymmetric beam and supported upon the bottom flange on either side thereof so that the open web of the beam is centrally disposed between end surfaces of the plank sections in substantially the same horizontal plane. A high-strength grout mixture applied to the assembled beam and plank sections is made to flow completely through the web openings in a circulatory manner thereby creating a substantially monolithic concrete encasement around the dissymmetric beam that improves the resulting composite action and mechanical interlock between the steel beam and concrete plank and prevents loss of strength due to separation of the grout from either side of the beam.

For a better understanding of these and other aspects of the present invention, reference may be made to the following detailed description taken in conjunction with the accompanying drawing in which like reference numerals designate like parts throughout the figures thereof.

DESCRIPTION OF THE PREFERRED EMBODIMENT

Figure 1:
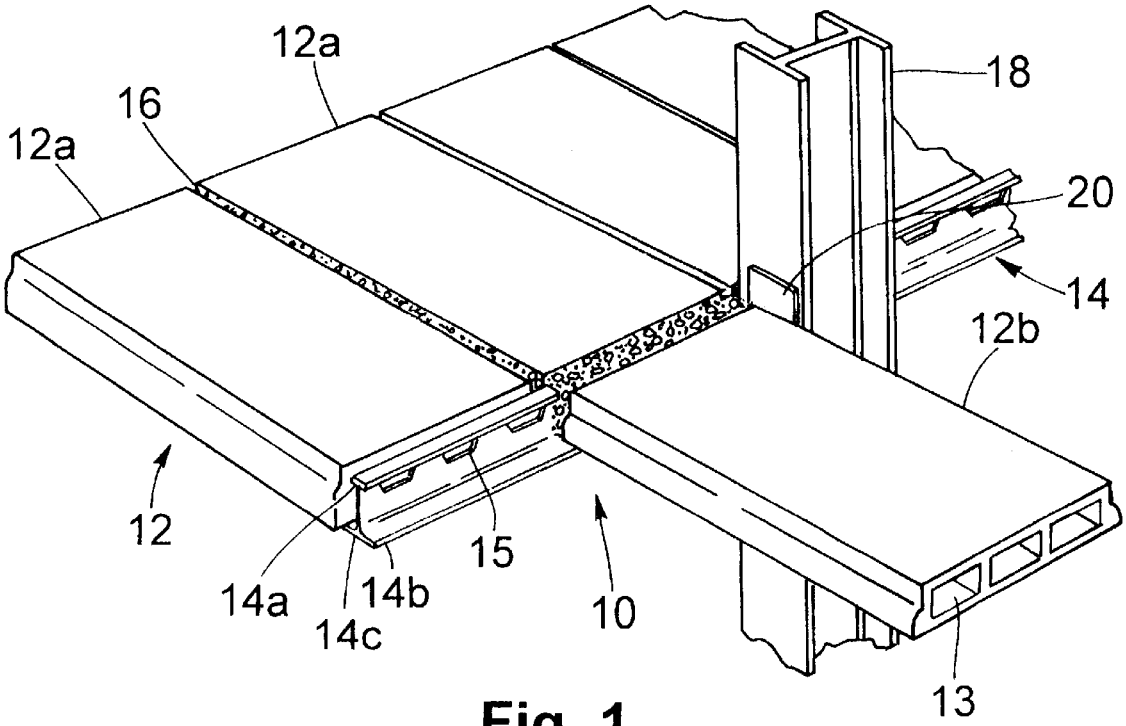
FIG. 1 is a fragmentary perspective view of the structural framing system assembled constructed in accordance with the present invention.
Figure 2:
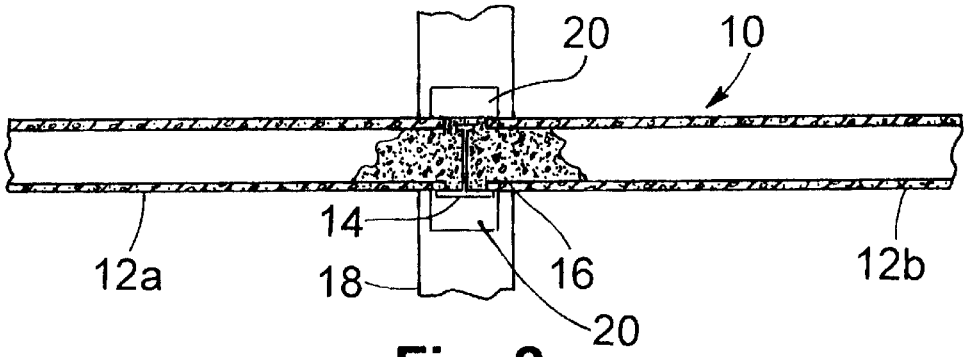
FIG. 2 is a front elevational view of the assembled structural framing system of FIG. 1 shown partially cross-sectioned.

Referring now to the drawings and in particular at first to FIGS. 1 and 2, a structural framing system, generally designated 10, is shown constructed in accordance with the present invention. The framing system 10 incorporates a series of concrete plank sections, generally designated 12, installed in successive pairs 12*a*, 12*b* and joined together along either side of a specially-configured steel dissymmetric beam 14 using a high-strength grout material 16, both described in greater detail hereinbelow. The plank sections 12*a*, 12*b* extend outward from the dissymmetric beam 14 and together span horizontally between adjacent vertical columns 18 that are fabricated of a structural steel material and erected on conventional foundations. As described in greater detail below, each dissymmetric beam 14 has a distinct top and bottom flange, 14*a* and 14*b* respectively, and an open web 14*c* extending longitudinally therebetween. In accordance with the present invention, each open web dissymmetric beam 14 is horizontally disposed and connected between the adjacent vertical columns 18 by conventional welding means further supported, as necessary, with standard beam-to-column connections secured to each vertical column.

The plank sections 12*a*, 12*b* are conventional precast and prestressed concrete members each typically formed having a series of hollow cores 13 extending transversely therethrough. Solid plank members without cores 13 may also be used in the present structural framing system 10 as plank sections 12*a*, 12*b* provided the end surfaces thereof are prepared with indentations therein as described below. The plank sections 12*a*, 12*b* installed in any specific structural framing system 10 are formed to have a substantially uniform thickness which may range from 6 to 12 inches between the upper and lower surfaces of the plank depending upon the specific design criteria associated with the particular construction. The end surfaces of each plank section 12, particularly those facing ends intended to be joined about the dissymmetric beam 14, are formed substantially perpendicular to the upper and lower plank surfaces to permit the respective pairs of plank sections 12*a*, 12*b* to be squarely placed and supported along either side of the dissymmetric beam with the plank sections and beam being disposed in substantially the same horizontal plane.

As better viewed in FIG. 2, the proximal end surfaces of the opposed plank sections 12*a*, 12*b* are similarly placed on each side of the dissymmetric beam 14 in juxtaposition therewith, particularly abutting the top flange 14*a* and bearing upon the bottom flange 14*b*, to provide an encasement area therebetween for the application and deposit of the high-strength grout material 16 at the time of joinder to the beam. In the case of the use of a solid plank member, the ends of the opposed plank sections 12*a*, 12*b* should have indentations formed along their edge surfaces to provide the same form of encasement area along either side of the open web dissymmetric beam 14. A conventional mixture of mortar or like cement material, the grout 16 is made having a strength rated in the range of 3,000–8,000 psi and is preferably premixed for application along the length of the dissymmetric beam 14 and between the assembled plank sections 12*a*, 12*b* so that the grout may flow through the beam and fill the encasement area in a manner described below in greater detail. Standard core plugs (not shown) generally round in configuration may be inserted into the hollow core 13 of each plank section 12*a*, 12*b* along their respective end surfaces to laterally confine and limit the encasement cavity and prevent the unnecessary flow of the grout material 16 away from the intended joint area immediately about the dissymmetric beam 14. Other types and forms of material suitable to dam the hollow core 13 near the ends of the plank sections 12*a*, 12*b* may also be used to limit the encasement area and confine the flow of grout material 16.

Figure 4:
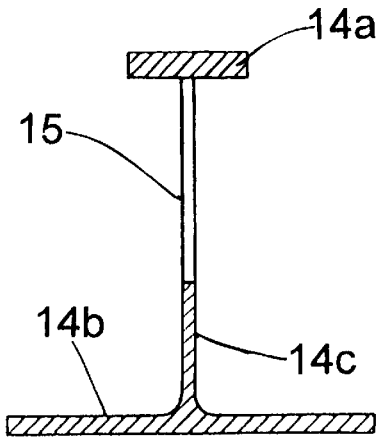
FIG. 4 is a cross-sectional view of the open-web dissymmetric beam taken along the line 4—4 in FIG. 3.
Figure 3:
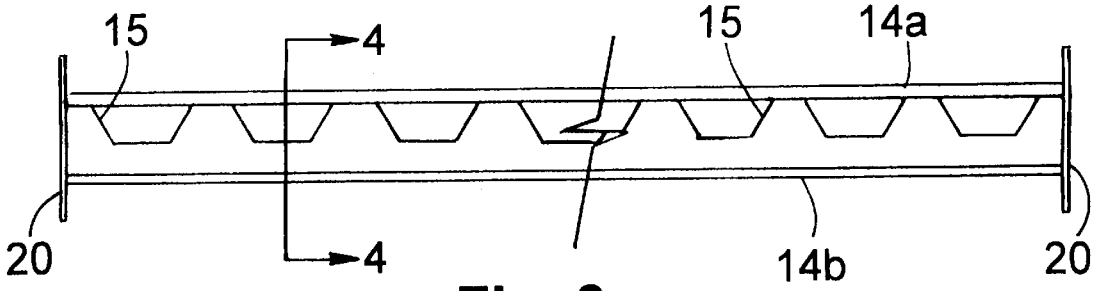
FIG. 3 is a side elevation view of the open-web dissymmetric beam used in present structural framing system and shown apart therefrom in substantially the horizontal attitude in which the beam is supported within the system of the present invention.
Figure 5:
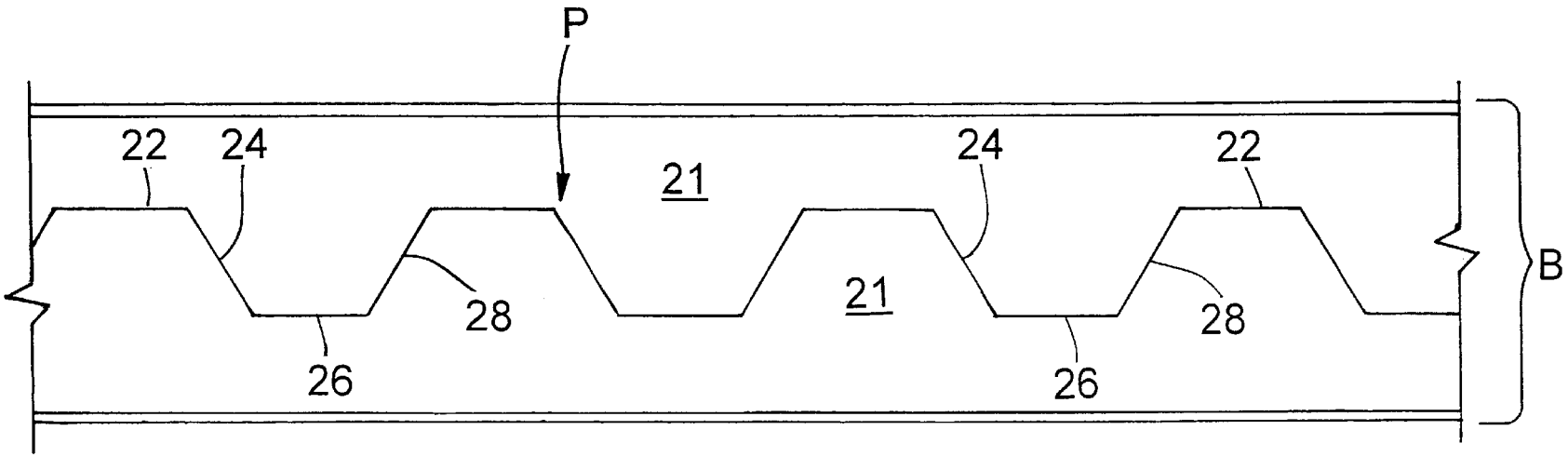
FIG. 5 is a diagrammatic representation of the continuous cutting pattern employed to obtain the open-web dissymmetric beam of FIGS. 3 and 4 for use in the present invention.

Referring now to FIGS. 3–5 in conjunction with FIGS. 1 and 2, the dissymmetric beam 14 of the present structural framing system 10 is specially fabricated to provide its open web 14*c* along the complete span of the beam between top flange 14*a* and bottom flange 14*b*. A plurality of openings 15 are provided along the upper edge of web 14*c* just beneath top flange 14*a*, each opening being similarly shaped having a substantially trapezoidal configuration, as best shown in FIG. 3. Adjacent openings 15 are equidistantly spaced apart along the length of the dissymmetric beam 14 with those openings located nearest to the far ends of the web 14*c* being spaced sufficiently from each respective end so that a solid web section is provided at either end of the beam between the top flange 14*a* and bottom flange 14*b* for more effective attachment to the vertical columns 18. The width of each opening 15 at the upper edge of web 14*c* and the spacing therealong between adjacent openings are substantially the same dimension and may be varied to alter the number and arrangement of openings depending upon the particular building construction and associated load requirements placed upon the structural framing system 10. The depth of each opening 15 may also vary in its dimension but generally extends through the centerline of the web 14*c*. Alternate rectilinear configurations or curvilinear shapes for the openings 15 made in web 14*c* may be equally suitable for incorporation in the dissymmetric beam 14 of the present invention provided that the respective configuration and number of such alternate openings do not compromise the structural integrity of the dissymmetric beam 14.

The present dissymmetric beam 14, particularly the open web 14*c* described above, is preferably made by cutting a standard rolled, wide flange structural steel beam, one such example being commonly known and commercially available as a W10×49 member. In this preferred method of fabricating the present dissymmetric beam 14, the standard rolled beam is cut through the entire length of its web according to a specific cutting pattern P intended to split the initial beam into separate wide flange beam sections 21 each with the plurality of openings 15 described above produced therein. As best viewed in FIG. 5, the cutting pattern P used to produce the plurality of openings 15 in the web 14*c* of dissymmetric beam 14 is a repetitive series of connected linear segments made on alternating levels upward and downward along the web of the standard beam. Appearing as a periodic rectilinear wave form spanning from one end of the beam to the other, the cutting pattern P is made of an upper horizontal segment 22, a downwardly and forwardly angled segment 24, a lower horizontal segment 26 and an upwardly and forwardly angled segment 28, repeated along the length of the beam symmetrically about the centerline thereof. Other periodic cutting patterns having similar alternating levels of either linear or curvilinear segments may be used in accordance with the present invention to split the standard beam into respective sections 21 having web openings in different geometric configurations suitable for the present structural framing system 10. Cutting of the standard rolled beam as aforedescribed may be accomplished by conventional flame cutting or mechanical means that may be in a semi-automatic or automatic assembly programmable to produce the specific cutting pattern. Alternatively, the open web dissymetric beam 14 of the present invention may be fabricated from separate plate members, respectively corresponding to the top flange 14*a*, bottom flange 14*b* and open web 14*c*, assembled together and welded in the dissymetric form described using conventional welding techniques in accordance with AISC or equivalent standards. In either method of fabrication of the open web dissymmetric beam 14, it should be understood that the web openings 15 be spaced apart along the entire length of the beam beneath the top flange 14*a* to promote optimal flow of the grout material 16 through and along the beam within the encasement area when constructing the structural framing system 10.

In the preferred method of fabrication described above in reference to FIG. 5, the respective beam sections 21 produced by the cutting pattern P are each separately employed and processed to produce the open-web dissymmetric beam 14 for use in the present structural framing system 10. To produce a single dissymmetric beam 14, a respective one of the beam sections 21 is combined with a length of flat bar plate made of structural steel material that is positioned across the top of the openings 15 along the entire length of the beam section in parallel alignment with the bottom flange 14*b*. Formed having a narrower width, typically in the range of 2–4 inches, and a greater thickness than corresponding dimensions of the bottom flange 14*b*, the length of bar plate is then welded to and across the open web 14*c* by fillet welding in accordance with AISC or equivalent standards. The resultant product is the open web dissymmetric beam 14 made in accordance with the present invention having its narrow, thickened top flange 14*a* disposed across and along the open web 14*c* substantially parallel to and aligned with the wide bottom flange 14*b*. The longitudinal profile of the open web 14*c*, best viewed in FIG. 3, reflects the resultant dissymmetric beam 14 having the series of trapezoidal openings 15 formed along the upper edge of the web throughout its length, the open web and its openings thus formed to provide routing for the free flow of grout 16 in a circulatory manner through the dissymmetric beam 14 upon its application to the assembled structural framing system 10 of the present invention. Prior to its placement and assembly in the framing system 10, the dissymmetric beam 14 may be further provided with solid web plates 20 welded to the beam at both ends for reinforcement of the beam member and support in its attachment to the vertical columns 18.

In constructing the present structural framing system 10, the open web dissymmetric beam 14 is lifted to a specific elevation and secured in a substantially horizontal position between adjacent vertical columns 18. Each dissymmetric beam 14 is attached to the corresponding vertical column 18 using standard end plate connections or other equivalent means for making the structural attachment thereto. With the dissymmetric beam 14 secured in such position having top flange 14*a* directed upwardly, the plank sections 12*a*, 12*b* are installed and assembled in pairs upon either side of the dissymmetric beam. Each plank section 12*a*, 12*b* is positioned alongside the dissymmetric beam 14 spanning outwardly therefrom in substantially the same horizontal plane as the beam and its open web 14*c*. Facing edges of the plank sections 12*a*, 12*b* are brought together to immediately abut the dissymmetric beam 14 so that the open web 14*c* of the beam is centrally disposed between the edges with the bottom flange 14*b* supporting the lower surfaces of the respective plank sections. In this position with the edges of the plank sections 12*a*, 12*b* bearing upon the bottom flange 14*b* of the beam 14 and the plank sections in horizontal planar alignment, the upper surface of the top flange 14*a* is substantially level with the upper surface of the plank sections, as best viewed in FIG. 2.

The described assembly of the horizontally spanning plank sections 12*a*, 12*b* and centrally disposed dissymmetric beam 14 is structurally joined together by the controlled application of grout 16 along the beam and into the encasement area formed by facing edges of the plank sections at and along their bearing on the open web dissymmetric beam. The grout material 16 is typically applied by pouring the material along the top flange 14*a* on either side of the dissymmetric beam 14 in sufficient amount to fill the encasement area around the beam. The grout material 16 is permitted to flow along and through the open web 14*c* from either side of the dissymmetric beam 14 in a circulating fashion routed via the plurality of openings 15 so that a more uniform and homogenous distribution of the grout results in the encasement area. Upon setting of the grout material 16 around the open web dissymmetric beam 14, a more solid and substantially monolithic concrete encasement is thus produced that enhances the effect of composite action developed in the framing system 10 and, as a further result, improves the overall structural integrity of the system. Load testing and evaluation of the constructed framing system 10 assembled with the open web dissymmetric beam 14 indicates a more monolithic concrete encasement and greater adherence between the steel and concrete materials, particularly in the encasement area around the interior of the beam. This increased monolithic quality and adherence effect in the concrete encasement area reduce the risk of composite failure and separation of the concrete around the beam and without the need for additional mechanical connections between the beam web and the grout.

Adjacent pairs of plank sections 12*a*, 12*b* are further installed and assembled together in a similar fashion at or about substantially the same time so that the grouting of the assembled pairs of plank along the open web dissymmetric beam 14 and between adjacent plank sections can proceed in a relative continuous operation. The process of installation and assembly of the plank sections 12*a*, 12*b* along the dissymmetric beam and the grouting thereof continues throughout the story level between all vertical columns and is repeated for each story of the construction.

The disclosed construction and assembly of the structural framing system 10 produces an improved composite action between the open web dissymmetric beam 14 and the plank sections 12*a*, 12*b* that significantly and unexpectedly increases the loadbearing capacity of the system far beyond that of the beam alone. The composite action of the present structural framing system 10, produced without use of shear connectors typically found atop steel beams in existing composite structures, is the result of enhanced mechanical interlocking and concrete encasement of the specially configured open web dissymmetric beam 14 secured centrally between the plank sections 12*a*, 12*b* and perpendicular to the span thereof. The composite action developed in the present framing system 10 by the improved mechanical interlocking of its structural elements contributes substantially to a determined increase in loadbearing capacity of the system that approximates twice that of the dissymmetric beam 14 itself. The combination of the open web dissymmetric beam 14 and the grouted plank sections 12*a*, 12*b* of the present structural framing system 10 further evidences a strengthening effect with respect to the structural integrity of the composite joint and the maintenance of the composite action over time.

Therefore, it is apparent that the disclosed invention provides an improved structural framing system and associated method of construction that produces a significant and unexpected increase in the composite action developed within the structural assembly, resulting in a substantial improvement in the structural integrity, strength and serviceability of the associated building in which the present system is employed. The present structural framing system provides a more cost effective and reliable means for supporting the load requirements of modern-day building structures, particularly those having multiple stories, than the structural framing systems heretofore developed. The present invention further provides an improved composite assembly of structural elements for framing multi-story construction that is more capable of handling all of the loading requirements now specified under standard building codes, including those lateral load requirements associated with potential seismic activity, within a minimum building elevation, and adapted to better maintain its composite strength and structural integrity over the useful life of the construction. In addition, the present invention provides a safe and effective structural framing system that can be assembled and implemented using relatively standard construction materials and equipment.

Obviously, other embodiments and modifications of the present invention will readily come to those of ordinary skill in the art having the benefit of the teachings presented in the foregoing description and drawings. For example, solid and reinforced concrete slab members could be used instead of the hollow core plank sections 12*a*, 12*b*, as previously indicated, with proper preparation of their respective end surfaces. Further, the depth or height of the open web 14*c* and corresponding dimension of the opening 15 therein may be varied depending upon the thickness of the plank sections 12*a*,12*b* employed, and particularly may be increased in size to level and accommodate a layer of cementitious topping that may be applied over top of the plank sections in certain building constructions. It is therefore to be understood that various changes in the details, materials, steps and arrangement of parts, which have been described and illustrated to explain the nature of the present invention, may be made by those skilled in the art within the principles and scope of the invention as expressed in the appended claims.

What is claimed:

1. A structural framing system for building construction, comprising:

a plurality of column members vertically erected;

an open web dissymmetric beam member horizontally supported between adjacent column members, said open web dissymmetric beam member having a plurality of web openings formed therein between a narrowed, thickened top flange and a widened bottom flange;

a plurality of concrete plank sections assembled in pairs spanning perpendicularly to either side of said open web dissymmetric beam member with the facing edges of each pair of assembled plank sections being supported upon the bottom flange of said open web dissymmetric beam member so that an encasement cavity is formed around the web openings between the top and bottom flanges; and a supply of grout material applied to said open web dissymmetric beam and said plank sections assembled thereto; said grout material being routed for flow through the web openings of said dissymmetric beam in a circulatory manner to fill the encasement cavity with a substantially monolithic concrete form and thereby provide increased strength and composite action to the system.

2. A structural framing system according to claim 1, wherein the web openings of said dissymmetric beam are substantially trapezoidal in configuration and formed just beneath the top flange.

3. A composite structural member, comprising:

an open web dissymmetric beam member having a plurality of web openings formed therein along the length thereof between a narrowed, thickened top flange and a widened bottom flange;

a pair of concrete plank sections assembled together along facing edges thereof on either side of said open web dissymmetric beam with the facing edges of each plank section being supported upon the bottom flange of said open web dissymmetric beam member so that an encasement cavity is formed around the web openings between the top and bottom flanges thereof; and a high-strength grout material applied to the assembled plank sections immediately surrounding said open web dissymmetric beam member, said grout material being routed for flow through the web openings of said dissymmetric beam member in a circulatory manner to fill the encasement cavity with a substantially monolithic concrete form thereby providing increased strength and composite action to the system.

4. A composite structural member according to claim 3, wherein the web openings of said dissymmetric beam member are formed just beneath the top flange having a trapezoidal configuration.

5. A method of constructing a building structure, comprising the steps of:

erecting vertical columns:

supporting an open web dissymmetric beam horizontally between adjacent vertical columns, said open web dissymmetric beam having a plurality of web openings formed therein between a narrowed, thickened top flange and a widened bottom flange;

installing a plurality of concrete plank sections in pairs along either side of said open web dissymmetric beam supported upon the bottom flange thereof, the plank sections being assembled together in a horizontal plane perpendicularly to either side of said open web dissymmetric beam with a cavity formed immediately surrounding the web openings between the top and bottom flanges; and applying a high-strength grout material to the installed plank sections immediately surrounding said open web dissymmetric beam, the grout material being routed along and through the web openings of said open web dissymmetric beam in a circulatory manner to fill the cavity with a substantially monolithic concrete encasement for improved composite action and strength of the building structure.

6. A method of constructing a building structure according to claim 5, wherein said step of supporting the open web dissymetric beam comprises:

lifting the beam to a specific story level of the building structure; and connecting each end of the beam to a respective one of the adjacent vertical columns in a substantially horizontal position having the narrowed, thickened top flange upwardly directed.

7. A method of constructing a building structure according to claim 6, wherein the web openings of the dissymmetric beam are formed just beneath the top flange having a trapezoidal configuration.

* * * * *